US006701840B2

(12) United States Patent
Hawkes

(10) Patent No.: US 6,701,840 B2
(45) Date of Patent: Mar. 9, 2004

(54) HOPPER GRIPPER DRUM

(75) Inventor: Richard B. Hawkes, Bethlehem, PA (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 70 days.

(21) Appl. No.: 09/952,094

(22) Filed: Sep. 13, 2001

(65) Prior Publication Data

US 2002/0043169 A1 Apr. 18, 2002

Related U.S. Application Data

(62) Division of application No. 09/506,625, filed on Feb. 18, 2000, now Pat. No. 6,308,625.

(51) Int. Cl.[7] ..... B41F 1/30
(52) U.S. Cl. ..... 101/409; 271/277
(58) Field of Search ..... 101/409, 410, 101/411, 415.1; 271/3.24, 81, 82, 83, 277

(56) References Cited

U.S. PATENT DOCUMENTS 3,895,657 A * 7/1975 Bilek ..... 139/438
4,358,100 A 11/1982 Muller ..... 271/11
4,759,290 A * 7/1988 Holl et al. ..... 101/415.1
4,815,870 A * 3/1989 Sparer et al. ..... 101/409
5,447,302 A 9/1995 Curley ..... 271/277
6,224,050 B1 5/2001 Wicki ..... 271/37

FOREIGN PATENT DOCUMENTS

DE 3035498 4/1981
EP 0967154 12/1999

* cited by examiner

*Primary Examiner*—Ren Yan
(74) *Attorney, Agent, or Firm*—Davidson, Davidson & Kappel, LLC

(57) ABSTRACT

A gripper drum device comprising a drum body rotatable about a central axis, an actuating shaft rotatable within the drum body, a box cam follower connected to the actuating shaft for moving the actuating shaft, a gripper seat connected to the actuating shaft, a gripper connected to the actuating shaft, and a box cam, the box cam follower being located within the box cam for following the box cam. Also provided is a method for gripping printed products including the steps of rotating a drum about a central axis, moving a cam follower within a box cam, and gripping a printed product with a gripper attached to the cam follower.

15 Claims, 3 Drawing Sheets

HOPPER GRIPPER DRUM

This application is a divisional of U.S. patent application Ser. No. 09/506,625 filed on Feb. 18, 2000 now U.S. Pat. No. 6,308,625.

BACKGROUND OF THE INVENTION

1. Field of the Invention

The present invention relates generally to printing presses and more particularly to a device and method for transporting printed products.

2. Background Information

U.S. Pat. No. 5,447,302 purports to disclose an apparatus for removing paper products from a stack on a hopper. The apparatus has a rotatably mounted gripper drum which rotates about a central axis at a constant angular velocity. A stationary cam is rigidly mounted adjacent the gripper drum. A cam follower follows the outer side of the cam, and is attached at one end to a link, which also rotates with the gripper drum. The rotating link is pivotable about a pin, so that a variation in the cam radius can cause the link to pivot, so that an other end of the link compresses or stretches a spring. This other end of the link connects to a further link which can retract a toggle arm on which a gripper and a gripper seat are supported. If the toggle arm is pulled so that the gripper and the gripper seat accelerate in the same direction as the movement of the gripper drum, the gripper is opened. If the gripper and the gripper seat are slowed down relative to the gripper drum, the gripper is closed.

The device of the '302 patent has the disadvantage that the link structure is complicated, especially in that a spring is required to force the cam to follow the cam follower. The repeated compression and expansion of the spring can lead to a weakening of the spring over many rotations and can cause the entire apparatus to malfunction. At high speeds, high spring forces must be maintained to keep the cam follower on the cam and the gripper from engaging properly. Departure of the follower from the cam can cause gripper malfunction or damage.

Moreover, the gripper force remains relatively constant regardless of toggle arm displacement. A large gripping force thus is necessary for thick products, which can then damage thin products if they are used on the same machine.

BRIEF SUMMARY OF THE INVENTION

An object of the present invention is to provide a rotating gripper drum which is durable and which has improved high speed operating characteristics. An additional or alternate objective is to provide a reliable rotating gripper gripper drum. Another additional or alternate objective is to provide a method and device for gripping with increased gripping force as product thickness increases.

The present invention provides a gripper drum device comprising a drum body rotatable about a central axis, an actuating shaft rotatable within the drum body, a box cam follower connected to the actuating shaft for moving the actuating shaft, a gripper seat connected to the actuating shaft, a gripper connected to the actuating shaft, and a box cam, the box cam follower being located within the box cam for following the box cam.

The box cam of the present invention controls and limits the movement of the cam follower, and eliminates the need for a spring to force the cam follower.

Advantageously, a gripper seat may be moved about a first axis by a first link to the cam follower, and the first axis being different from an axis of the actuating shaft. The actuating shaft preferably is connected to the gripper by a second link.

By separating the link between the actuating shaft and the gripper seat from that between the cam follower and the gripper, gripping movement can be better controlled, so that, for example, a smoother pick-up of printed products can be obtained.

Advantageously, the second link connects directly to the cam follower and drives a rack of a rack-and-pinion mechanism, the pinion being connected to the gripper. The gripper seat preferably is connected directly on the first link, which is driven by a support link connected directly between the first link and the cam follower.

The gripper preferably is spring-loaded, in that a spring is located directly between the spring and a spring support attached to the rotating drum. Because the spring in the present embodiment acts only against the gripper, it may be compact and not suffer acceleration distortions which had been present in the prior art. Moreover, because the spring acts solely on the gripper, the gripping force advantageously may be increased as the gripped product becomes thicker. This permits a small initial load to be applied for thin products, and results in less damage to these products. Less wear of components and less required torque for the entire system thus is also results.

The present invention also provides a gripper drum comprising a drum body rotatable about a central axis, a gripper movable at an outer circumference of the drum body, a gripper seat for interacting with the gripper, and a cam follower connected to the gripper seat by a first link and connected to the gripper by a second link different from the first link.

The present invention also provides a method for gripping printed products including the steps of rotating a drum about a central axis, moving a cam follower within a box cam, and gripping a printed product with a gripper attached to the cam follower.

The term "box cam" as used herein is defined as a cam having a groove or slot in which a cam follower rides and which constrains the cam in both a radially outward and radially inward direction.

BRIEF DESCRIPTION OF THE DRAWINGS

A preferred embodiment of the present invention is described below by reference to the following drawings, in which.

DETAILED DESCRIPTION

Figure 1:
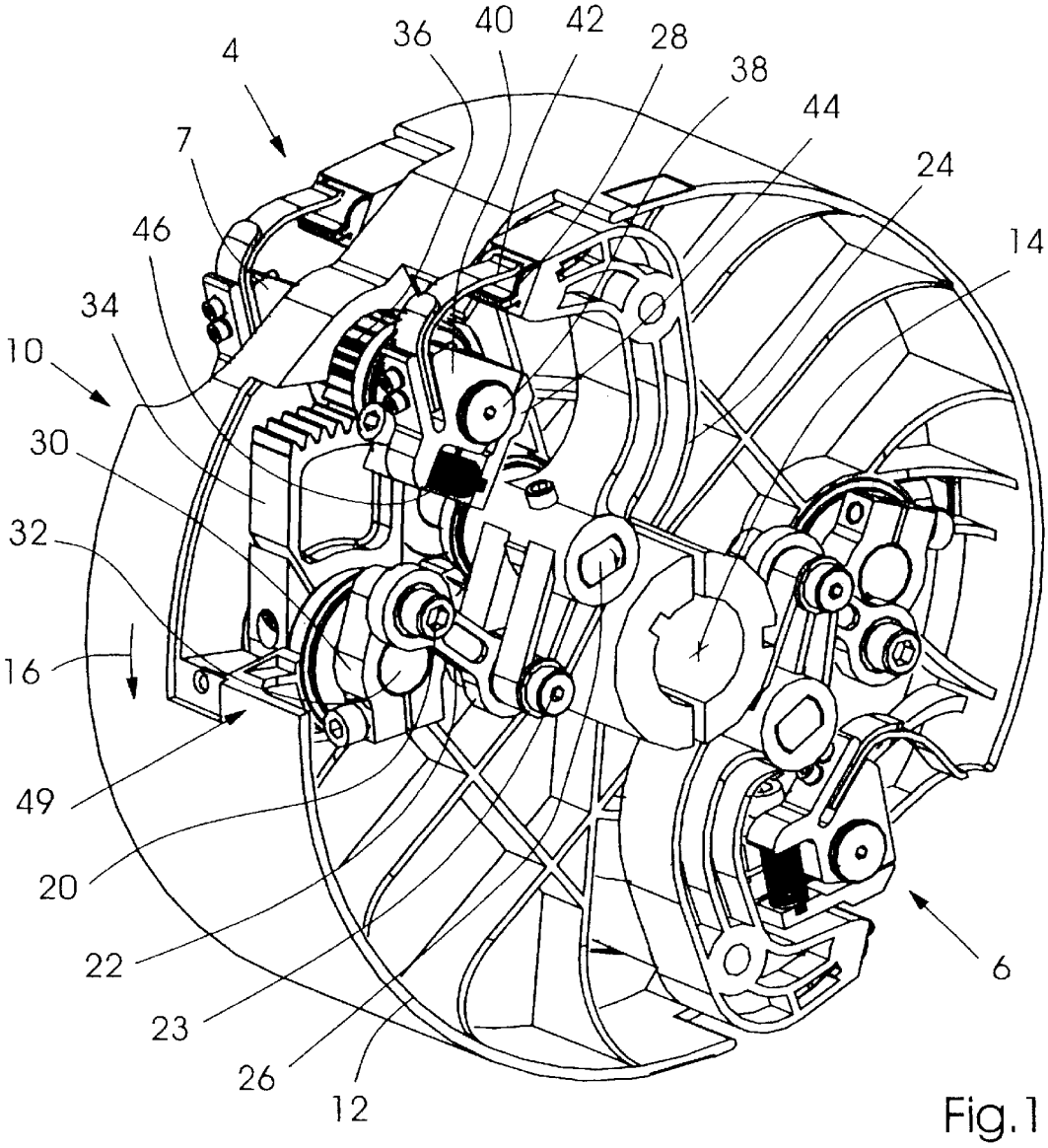
FIG. 1 shows a perspective view of the inside of a gripper drum of the present invention.

FIG. 1 shows a gripper drum 10 which has a drum body 12 which rotates about a central axis 14 in the direction of an arrow 16. Gripper drum 10 preferably is driven at a constant velocity by a drive mechanism having a drive axle which rotates about central axis 14 and fits into the center of drum body 14. Gripper drum 10 also includes a pin 20 which is attached at one end of a support link 22. Connected rotatably to the other end of support link 22 through a pin 23 is a gripper seat link 24, which is rotatable about an axis 26.

A gripper seat 28 is attached to one end of gripper seat link 24. Gripper seat 28 preferably is made of a high friction material, such as rubber.

A cam follower 120 (FIG. 2), on the side of the drum which is not shown, connects to a shaft 32, which, on the side shown in FIG. 1, supports a follower link 30 attached by a pin 20 to a support link 22. Follower link 30 is clamped fixedly to a shaft 32. Shaft 32 also rotates a rack 34 geared to a pinion 36 of a rack and pinion mechanism. Pinion 36 is connected to a shaft 38, on which is a gripper 40 having a gripper end 42.

Gripper end 42 is spring-loaded to a closed position by a spring 46 attached to a spring support 44 connected to drum body 12.

Gripper 40 and gripper seat 28 are movable relative to the drum body 12 within a slot 49 at the outer circumference of drum body 12.

A second gripper mechanism 6 similar to that described above is located 180 degrees about drum body 12.

The device is generally symmetrical to support a gripper 7 on the other side of drum 10. However, on the opposite side of the drum, a gripper seat link is moved by virtue of axis or axle 26, thereby eliminating the need for a support link similar to support link 22 on that side of the drum.

Figure 3:
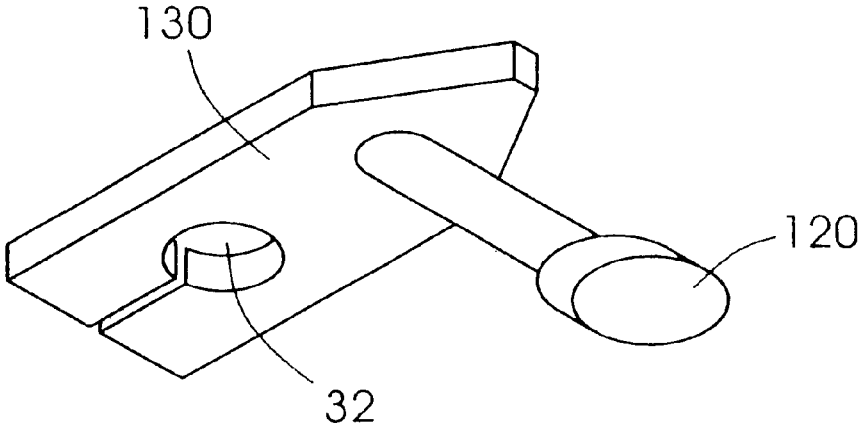
FIG. 3 shows the cam follower which is attached to the side of the gripper drum not shown in FIG. 1.
Figure 4:
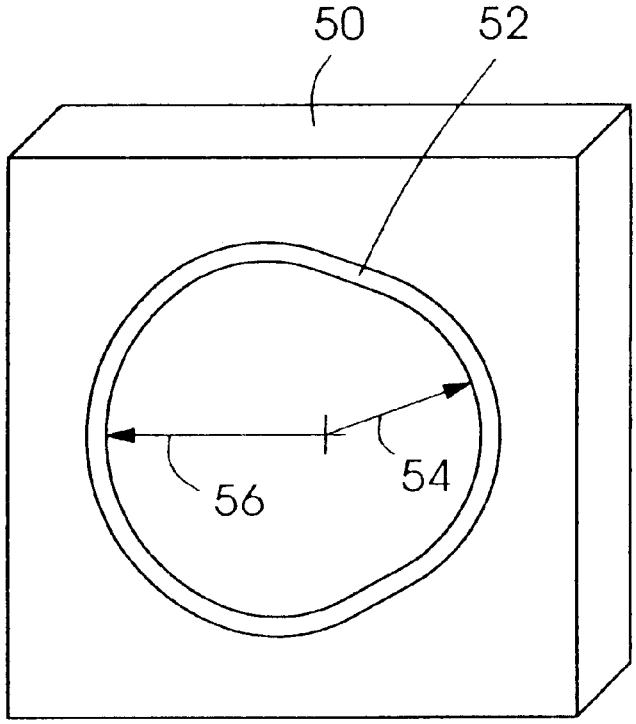
FIG. 4 shows a box cam of the gripper drum device of the present invention.

As shown in FIG. 3, on the opposite side of the gripper drum, which is not shown in FIG. 1, a support 130 is attached to the other end of shaft 32. A cam follower 120 is attached to support 130, and runs in a box cam 50 as shown in FIG. 4. As stated, on the cam side of the drum 10 no similar link to link 22 is present, since the gripper seat link on the cam side is moved by the axle 26, which extends through the gripper drum.

Gripper drum 10 operates as follows. As the gripper drum body 14 rotates, cam follower 120 follows a groove 52 in box cam 50, as shown in FIG. 4. Box cam 50 is located at the side of drum body 12 to receive cam follower 120. In a section of groove 52 having an inner radius 54, the gripper 40 is open and gripper 40 and gripper seat 28 are moved forward in groove 49 at the outer circumference of drum body 12.

When cam follower 20 reaches a portion of groove 52 having a bigger radius 56, cam follower 120 moves radially outward, which rotates axle 32 counterclockwise as shown in FIG. 1. Link 22 then pulls an end of gripper seat link 24 so as to rotate axle 26 clockwise as shown in FIG. 1 by an arrow. Gripper seat 28 thus moves backward with respect to rotating drum body 12 (and opposite arrow 16 in FIG. 1). On the opposite side of the drum 10, axle 26 activates a gripper seat link to likewise move a gripper seat of gripper 7 backwards.

At the same time, since cam follower 120 moves shaft 32 counterclockwise, rack 34 attached on shaft 32 is caused to rotate counterclockwise as shown in FIG. 1. Pinion 36 thus rotates clockwise, as does shaft 38, which causes gripper 40 to rotate. Gripper edge 42 thus moves backward (opposite the direction of arrow 16) in groove 49 and eventually closes on gripper seat 28, thereby gripping a printed product on a hopper stack. The opposite side of drum 10 may have a similar rack attached on shaft 32 for activating a similar pinion mechanism.

Spring 44 and the positioning of gripper edge 42 with respect to the gripper seat 28 can control the strength of the grip in the closed position. The spring 44 provides gripping force for thicker products.

Figure 2:
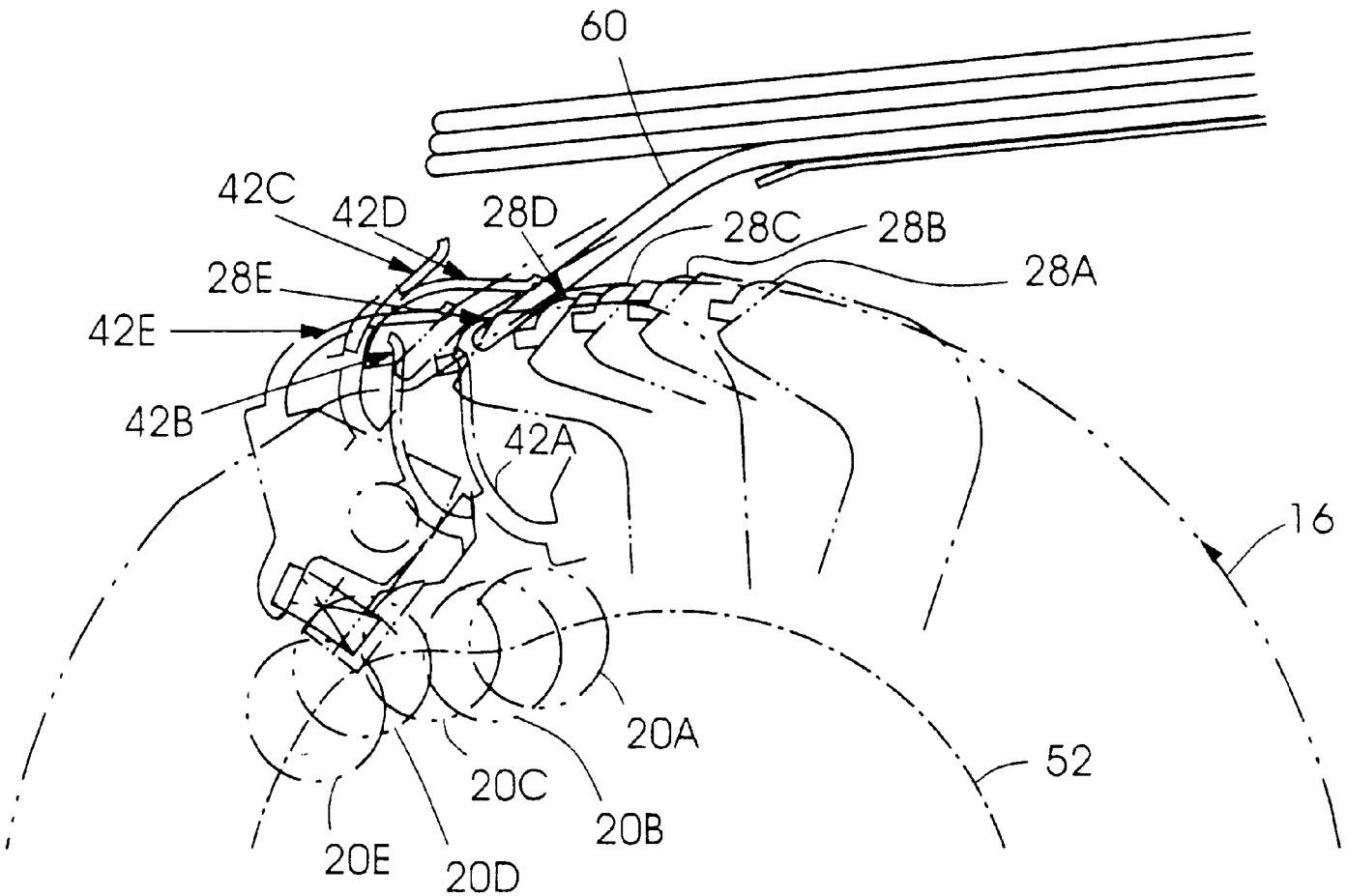
FIG. 2 shows the gripper drum of FIG. 1 gripping a printed product from a hopper.

FIG. 2 shows the movement of gripper edge 42 and gripper seat 28 (FIG. 1) when gripping a product 60. When cam follower 120 is in position 20A, gripper seat 28 is in position 28A and is apart from gripper edge 42 at position 42A. As the cam follower 120 moves to position 20B, gripper seat 28 moves forward to position 28B and gripper edge to position 42B. As the cam follower moves to position 20C, gripper seat 28 is moving back in slot 49 (FIG. 1) opposite direction 16. The motion of drum 10 in direction 16 is slightly faster than this backwards movement, so that gripper seat 28 still is moving in direction 16, but slower than drum 10. At the same time, gripper edge 42 has moved to position 42C.

As the cam follower 120 moves outwardly to position 20D, gripper seat 28 at position 28D and gripper edge 42 at position 42D grip product 60 from a hopper stack. As the cam follower moves on to position 20E, the gripped product is moved forward, so that gripper edge 42 and gripper seat 28 are in position 42E and 28E, respectively.

Referring to FIG. 4, when the cam returns to inner radius 54, the cam follower moves inwardly and releases the product 60, for example, to a conveyor belt.

U.S. Pat. No. 5,447,302 is hereby incorporated by reference herein.

Advantageously, the rotational axis of the gripper seat link 24 and the rotational axis of drum 10 are different, which can permit better gripping characteristics.

What is claimed is:

1. A gripper drum comprising:

a drum body rotatable about a central axis;

a gripper movable at an outer circumference of the drum body;

a gripper seat for interacting with the gripper; and an actuating shaft connected to the gripper seat by a first link and connected to the gripper by a second link different from the first link; the first link, in operation, actuating the gripper seat and the second link, in operation, actuating the gripper.

2. The gripper drum as recited in claim 1 wherein the first link includes a follower link connected directly to the actuating shaft and the second link includes a rack connected directly to the actuating shaft.

3. The gripper drum as recited in claim 1 wherein the actuating shaft is connected to a box cam follower.

4. The gripper drum as recited in claim 1 wherein the first link includes a gripper seat link between the gripper seat and the actuating shaft, the gripper seat link having a rotational axis different from the central axis.

5. The gripper drum as recited in claim 4 wherein the gripper seat link is rotatable about a second shaft.

6. The gripper drum as recited in claim 4 further comprising a support link connected to the gripper seat link, the gripper seat link being directly connected to the gripper seat.

7. The gripper drum as recited in claim 6 further comprising a follower link directly connecting the actuating shaft to the support link.

8. The gripper drum as recited in claim 1 wherein the first link includes a follower link directly connecting the actuating shaft to the cam follower.

9. The gripper drum as recited in claim 1 wherein the second link includes rack and pinion gears.

10. The gripper drum as recited in claim 1 wherein the gripper is spring-loaded.

11. The gripper drum as recited in claim 1 further comprising a spring directly connected between the gripper and the drum body.

12. A gripper drum comprising:

a drum body rotatable about a central axis;

a gripper movable at an outer circumference of the drum body;

a gripper seat for interacting with the gripper; and an actuating shaft connected to the gripper seat by a first link and connected to the gripper by a second link different from the first link;

wherein the first link includes a gripper seat link between the gripper seat and the actuating shaft, the gripper seat link having a rotational axis different from the central axis.

13. The gripper drum as recited in claim 12 wherein the gripper seat link is rotatable about a second shaft.

14. The gripper drum as recited in claim 12 further comprising a support link connected to the gripper seat link, the gripper seat link being directly connected to the gripper seat.

15. The gripper drum as recited in claim 14 further comprising a follower link directly connecting the actuating shaft to the support link.

* * * * *